US006089404A

United States Patent [19]

Mecks

[11] Patent Number: 6,089,404

[45] Date of Patent: Jul. 18, 2000

[54] TUBE WITH A METALLIC CASING AND A LABEL AND METHOD OF MAKING SAME

[75] Inventor: Gernot Mecks, Hoechst, Germany

[73] Assignee: Wella Aktiengesellschaft, Darmstadt, Germany

[21] Appl. No.: 09/306,619

[22] Filed: May 4, 1999

[30] Foreign Application Priority Data

May 16, 1998 [DE] Germany ..... 198 22 068

[51] Int. Cl.[7] ..... B65D 35/00

[52] U.S. Cl. ..... 222/92; 222/107

[58] Field of Search ..... 222/92, 94, 107

*Primary Examiner*—Joseph A. Kaufman
*Assistant Examiner*—Thach Bui
*Attorney, Agent, or Firm*—Michael J. Striker

[57] ABSTRACT

The tube (1) has a metallic casing (2) and a label (3) on the casing. In order to improve the seal of the tube at the fold (6) the label (3) extends beyond the edge region (5) at the end of the tube (1) opposite to the cap (4) to form two adjacent label edge portions (10) and a weld seam or glue seam (9) is provided between the adjacent label edge portions (10) at the fold (6). The weld or glue seam (9) can seal the rear edge (7) of the casing (2) or only prevent an unfolding or release of the fold (6) at the edge region (5).

4 Claims, 3 Drawing Sheets

TUBE WITH A METALLIC CASING AND A LABEL AND METHOD OF MAKING SAME

BACKGROUND OF THE INVENTION

1. Field of the Invention

The present invention relates to a tube comprising a metallic casing or jacket, a label on the casing, a closure device for closing a dispensing opening and a fold in a flattened edge region of the casing. The invention also relates to a method of making this kind of tube.

2. Prior Art

A plastic label applied to the casing provides product information in the known tube of this kind with a metallic casing. A product in these tubes is dispensed from the dispensing opening by squeezing or compressing the casing after opening the closure device. After filling the tube it is flattened at an edge region of the casing opposite the closure device and closed by means of a fold in the edge region.

The known tube of this kind has the disadvantage that the fold does not reliably seal the product from the surroundings of the tube.

SUMMARY OF THE INVENTION

It is an object of the present invention to provide a tube of the above-described kind with a reliable seal in the vicinity of its fold and without introduction of an additional tube element or part.

It is also an object of the present invention to provide a method of making the tube according to the invention.

These objects, and others that will be made more apparent hereinafter, are attained in a tube comprising a metallic casing, a label on the casing, a closure device for closing a dispensing opening and a fold in a flattened edge region of the casing.

According to the invention the label extends beyond the edge region to form two adjacent label edge portions and a weld or glued seam between the two adjacent label edge portions is provided at the fold.

In the method according to the invention the label is placed in a position adjacent the edge region and the label is heat-sealed, welded or glued at the edge region in order to seal the tube.

The invention has the advantage that the tube is reliably sealed in the vicinity of its fold and no additional tube parts or components are required. The label extending over the flattened edge region of the tube is also used to provide a seam sealing the tube or a seam that prevents a release or unfolding of the fold. The sheathing of the casing with the label or the application of the label to the casing can occur in the conventional manner. Because of the rather long form of the label it can also be used to seal the edge region of the casing by means of a heat-sealed plastic seam or to glue it by means of an adhesive, or to secure the fold against opening.

Preferred embodiments of the invention are disclosed in more detail hereinbelow and in the appended claims.

If the label extends beyond the edge region and a projecting portion of the label extending beyond the edge region is heat-sealed, welded or glued, the edge region can be folded in connection with this heat-sealing, welding or gluing process in a preferred embodiment. The heat-sealed, welded or glued portion can be arranged between the folded over edge region of the casing by the folding process and in this way is not visible to the consumer. Also the heat-seal or glue seam is comparatively safe from damage when it is held in the fold.

In another preferred embodiment the label can be sealed or joined again after the fold by means of an additional seam or weld at the fold, so that the fold is protected in this way prior to folding up. This seam is also sufficient for a single seal of the edge region, so that the first heat-sealing, welding or gluing can be dispensed with. The heat-sealed, welded or glued label can also be first folded over about 180° and then heat-sealed, welded or glued, for subsequent folding of the edge region. In each case the fold is sealed by means of a seam or joint.

In another preferred embodiment the label is closed with an edge of the casing, is folded with the edge of the casing and then is heat-sealed, welded or glued together with this edge. The label can be formed comparatively short. In the case of a casing made of metal or having at least one metal layer, for example, an inductive high frequency method is suitable as the welding process.

BRIEF DESCRIPTION OF THE DRAWING

The objects, features and advantages of the invention will now be illustrated in more detail with the aid of the following description of the preferred embodiments, with reference to the accompanying figures in which.

DESCRIPTION OF THE PREFERRED EMBODIMENTS

Figure 1:
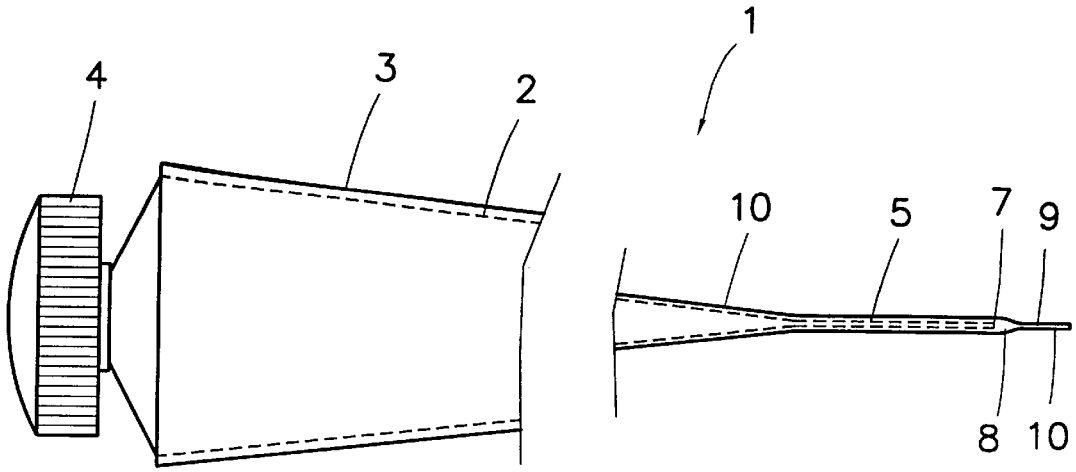
FIG. 1 is a side view of a tube according to the invention, with a closure device, a metal casing, a thermoplastic label surrounding the metal casing, in which an edge region of the metal casing is compressed, the label extends beyond the edge region and the portion of the label extending beyond the edge region is sealed by means of a weld seam.
Figure 2:
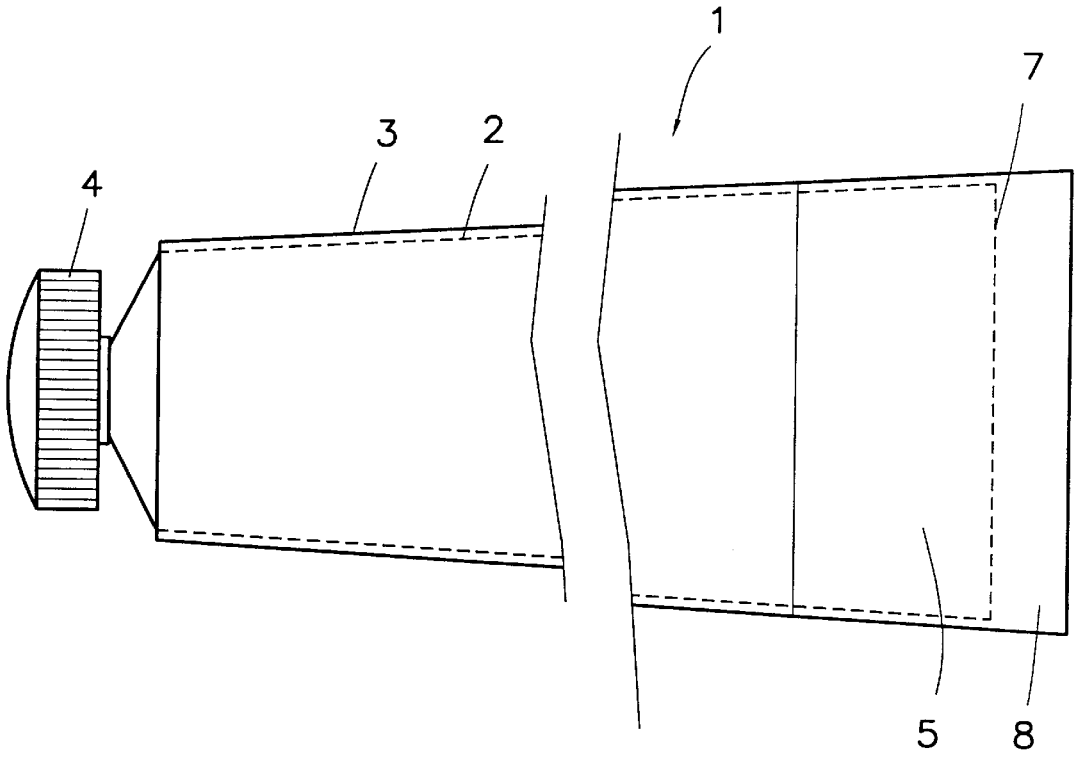
FIG. 2 is a top plan view of the tube shown in FIG. 1.
Figure 3:
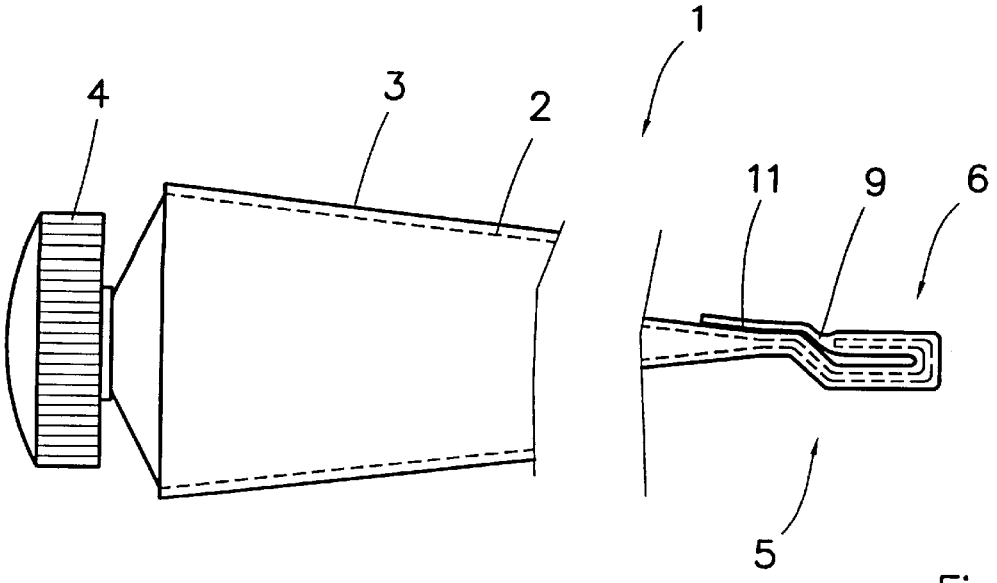
FIG. 3 is a side view of the tube shown in FIG. 1, but with the edge region folded over.

A tube 1 has a metallic casing 2, which is surrounded by a label 3 made of thermoplastic material (FIG. 1, FIG. 2). A closure device 4, e.g. a cap, is screwed on a dispensing opening of the tube 1. The casing 2 is squeezed together or compressed at a rear end of the tube 1, so that a flattened edge region 5 is formed. The edge region 5 is provided for a later folding to produce a fold 6 (FIG. 3).

The label 3 extends beyond the edge region 5 and projects over the edge 7 (FIG. 1, FIG. 2).

During manufacture the tube 1, whose label 3 contacts the edge region 5 and extends beyond it, is first filled. Then the edge region 5 of the casing 2 is flattened. The label 3 projecting beyond the edge 7 of the casing 2 or its projecting portion 8 is subsequently welded or sealed, whereby a weld seam 9 sealing the tube 1 is produced.

The tube sealed in this manner is folded over at edge 7 or its edge region 5, whereby the fold 6 arises and the weld seam 9 between the two opposing adjacent or contacting label edge portions 10 arrives in the fold 6. After the folding process the label 3 is welded again in order to produce an additional weld seam 11 at the fold 6 (FIG. 3). The weld seam 11 prevents opening of the fold 6.

Figure 4:
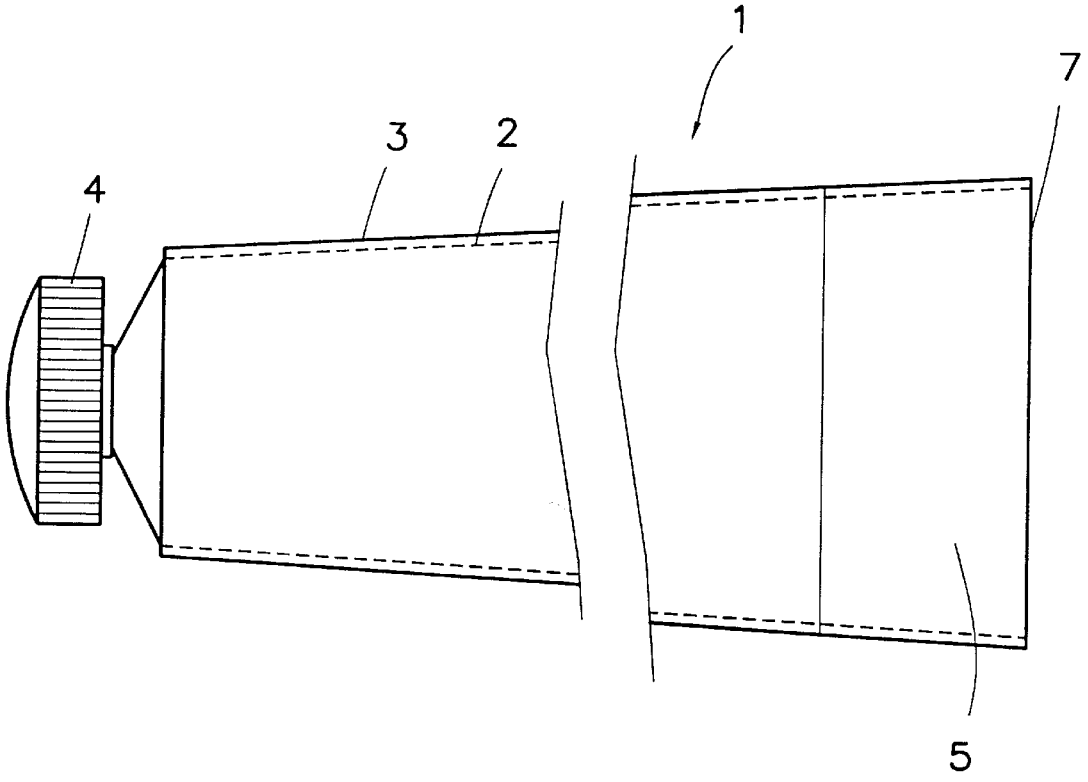
FIG. 4 is a top plan view of another embodiment of a tube according to the invention and similar to that shown in FIG. 2, however with a label which is closed together with the edge of the casing.
Figure 5:
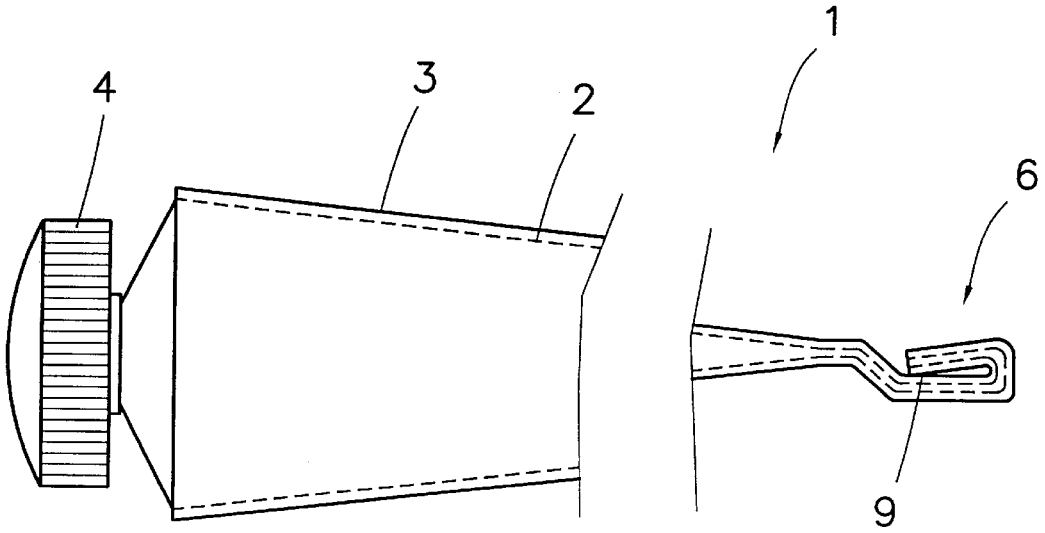
FIG. 5 is a side view of the tube shown in FIG. 4, however with folded and welded edge region.

In the embodiment shown in FIGS. 4 and 5 the label 3 is closed together with the edge 7 of the casing 2 opposite from the closure device 4. The label 3 is folded with the casing 2 and subsequently welded or heat-sealed. A weld seam 9 is produced by means of inductive high frequency heating in the fold 6, which operates to prevent an unfolding or releases of the fold 6, whereby the tube 1 is reliably sealed in the vicinity of its fold 6.

Similar to the embodiments described above the tube can also have a paper label, a non-thermoplastic plastic label or a laminate label and the label can have a glued seam instead of a weld seam at the positions described above.

The disclosure in German Patent Application 198 22 068.5 of May 16, 1998 is incorporated here by reference. This German Patent Application describes the invention described hereinabove and claimed in the claims appended hereinbelow and provides the basis for a claim of priority for the instant invention under 35 U.S.C. 119.

While the invention has been illustrated and described as embodied in a tube with a metallic casing and a label and method of making same, it is not intended to be limited to the details shown, since various modifications and changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed is new and is set forth in the following appended claims:

I claim:

1. A tube comprising a metallic casing (2), a label (3) on the casing, a closure device (4) for closing a dispensing opening and a fold (6) in a flattened edge region (5) of the casing;

wherein the label (3) extends beyond the edge region (5) to form two adjacent label edge portions (10) and at the fold (6) a weld or glued seam (9) between said two adjacent label edge portions (10) is provided.

2. A tube comprising a metallic casing (2), a label (3) on the casing, a closure device (4) for closing a dispensing opening and a fold (6) in a flattened edge region (5) of the casing;

wherein the label (3) extends around the casing (2) and has a projecting portion (8) extending beyond the edge region (5) and the projecting portion (8) is provided with a weld or glue seam (9).

3. The tube as defined in claim 2, further comprising an additional weld seam or glue seam (11) between the projecting portion (8) of the label (3) and another portion of the label (3) at said fold (6).

4. A tube comprising a metallic casing (2), a label (3) on the casing, a closure device (4) for closing a dispensing opening and a fold (6) in a flattened edge region (5) of the casing;

wherein the casing (2) has an edge (7) at an end opposite from the closure device (4) and the label (3) is sealed together with said edge (7) of the casing in order to seal the casing (2).

* * * * *